US009139333B2

(12) United States Patent
Subacchi

(10) Patent No.: US 9,139,333 B2
(45) Date of Patent: Sep. 22, 2015

(54) COMPOSITE PALLETS FOR MOLDING CONCRETE PIPE

(71) Applicant: Hawkeye Concrete Products Co., Mediapolis, IA (US)

(72) Inventor: Claudio Subacchi, Mediapolis, IA (US)

(73) Assignee: Hawkeye Concrete Products Co., Mediapolis, IA (US)

( * ) Notice: Subject to any disclaimer, the term of this patent is extended or adjusted under 35 U.S.C. 154(b) by 50 days.

(21) Appl. No.: 13/875,423

(22) Filed: May 2, 2013

(65) Prior Publication Data

US 2013/0291766 A1 Nov. 7, 2013

Related U.S. Application Data

(60) Provisional application No. 61/642,136, filed on May 3, 2012.

(51) Int. Cl.
*B28B 21/76* (2006.01)
*B65D 19/26* (2006.01)
(Continued)

(52) U.S. Cl.
CPC ..... *B65D 19/0004* (2013.01); *B28B 7/166* (2013.01); *B28B 7/348* (2013.01); *B28B 21/765* (2013.01); *B65D 19/0032* (2013.01); *B65D 19/0053* (2013.01); *B65D 2519/00024* (2013.01); *B65D 2519/00034* (2013.01); *B65D 2519/00039* (2013.01); *B65D 2519/00044* (2013.01); *B65D 2519/00059* (2013.01); *B65D 2519/00129* (2013.01); *B65D 2519/00139* (2013.01); *B65D 2519/00258* (2013.01); *B65D 2519/00273* (2013.01);
(Continued)

(58) Field of Classification Search
CPC ..... B65D 19/0004; B65D 19/0053; B65D 19/0055; B65D 19/0057; B65D 19/0067; B28B 21/02; B28B 21/42; B28B 21/765
USPC ..... 425/470; 249/100, 149.204, 149, 204
See application file for complete search history.

(56) References Cited

U.S. PATENT DOCUMENTS 1,941,812 A 1/1934 Muntz
3,078,539 A 2/1963 Duplesis
(Continued)

FOREIGN PATENT DOCUMENTS

DE 1759687 7/1971
DE 3721077 1/1989
(Continued)

OTHER PUBLICATIONS

International Search Report and Written Opinion of the International Searching Authority dated Oct. 9, 2014 from related PCT patent application No. US2014/012728.
(Continued)

*Primary Examiner* — Michael Safavi
(74) *Attorney, Agent, or Firm* — Jason R. Sytsma; Shuttleworth & Ingersoll, PLC

(57) ABSTRACT

Pallet includes an inner structural support with a bottom section and a top section. The top section has an upward facing, load bearing surface that is bonded with a substantially smooth polymer layer. More specifically, the bottom section includes an annular ring that supports a top section comprising an annular ring and a flange that supports the load. The top section is bonded with a polymer to form a smooth surface suitable for curing concrete.

19 Claims, 2 Drawing Sheets

(51) Int. Cl.

| | |
|---|---|
| ***B65D 19/00*** | (2006.01) |
| ***B28B 7/16*** | (2006.01) |
| ***B28B 7/34*** | (2006.01) |

(52) U.S. Cl.

CPC ..... *B65D 2519/00288* (2013.01); *B65D 2519/00293* (2013.01); *B65D 2519/00318* (2013.01); *B65D 2519/00348* (2013.01); *B65D 2519/00437* (2013.01); *B65D 2519/00562* (2013.01); *B65D 2519/00815* (2013.01); *B65D 2519/00855* (2013.01)

(56) References Cited

U.S. PATENT DOCUMENTS

| | | | |
|---|---|---|---|
| 3,201,843 | A | 8/1965 | Osweiler |
| 3,584,356 | A | 6/1971 | Joelson |
| 3,773,447 | A | 11/1973 | Barratt |
| 3,941,347 | A | 3/1976 | Robertson et al. |
| 4,047,693 | A | 9/1977 | Holme |
| 5,259,586 | A | 11/1993 | Miller, Sr. |
| 6,004,126 | A | 12/1999 | Strobel |
| 2013/0291766 | A1 | 11/2013 | Subacchi |

FOREIGN PATENT DOCUMENTS

| | | |
|---|---|---|
| DE | 102009016804 | 10/2010 |
| EP | 0686245 | 6/2000 |
| SU | 650820 | 3/1979 |

OTHER PUBLICATIONS

International Search Report and Written Opinion of the International Searching Authority dated is Jul. 9, 2013 from counterpart PCT patent application.

COMPOSITE PALLETS FOR MOLDING CONCRETE PIPE

The present invention claims priority to U.S. Provisional Patent Application No. 61/642,136 filed on May 3, 2012, the content of which are hereby incorporated by reference herein.

BACKGROUND

The inventions disclosed here in relate generally to form structures used for manufacturing concrete products. More specifically the mention relates to composite pallets and the method of manufacturing the composite pallets, which are used for forming the end of a concrete product and supporting and transporting the concrete products, such as culverts, pipes, and the like during the manufacture and curing processes.

Concrete pipes are manufactured by casting a concrete mixture or slurry in a mold. The mold is mounted coaxially on a pallet or base for curing. Traditionally, pallets for concrete pipes are made from cast iron, cast steel, fabricated steel, or pressed steel. A steel base, however, is expensive because of the high cost of steel and the high cost of working it. In relatively large plants for making concrete pipe, the steel bases alone require a substantial capital investment.

SUMMARY

A composite pallet is disclosed that provides a base that is relatively inexpensive compared to the prior art steel bases, and yet performs as well as the steel bases. The pallet includes an inner structural support with a bottom section and a top section. The top section has an upward facing, load bearing surface that is bonded with a substantially smooth polymer layer. More specifically, the bottom section includes an annular ring that supports a top section comprising an annular ring and a flange that supports the load. The top section is bonded with a polymer to form a smooth surface suitable for curing concrete.

DESCRIPTION OF THE ILLUSTRATED EMBODIMENTS

Figure 1B:
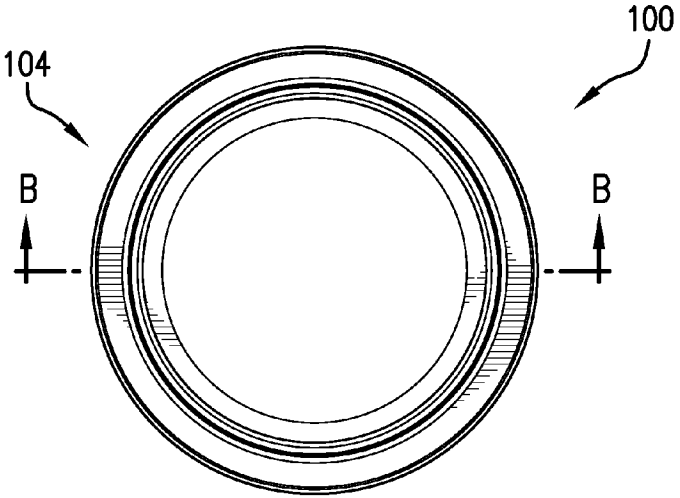
FIG. 1B is a top view of the pallet of FIG. 1A.
Figure 1D:
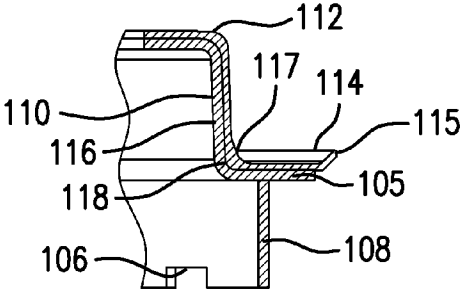
FIG. 1D is a close up view of the area D of FIG. 1C.
Figure 1A:
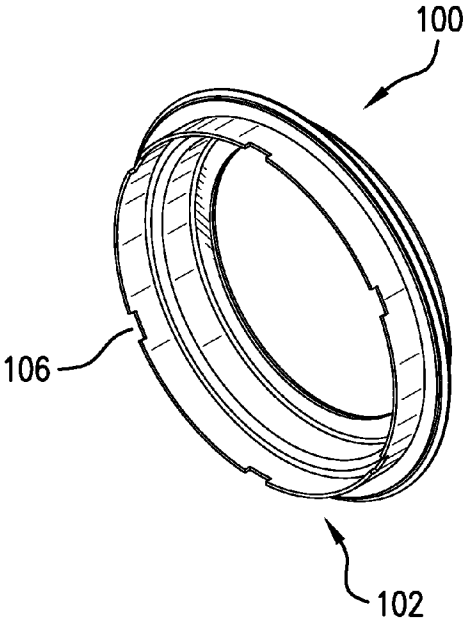
FIG. 1A is a perspective view of a first embodiment of a pallet for concrete pipe.
Figure 1C:
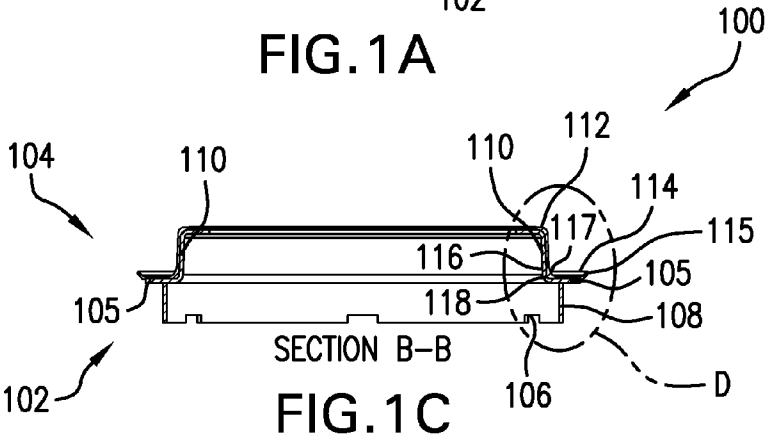
FIG. 1C is a side view of the pallet of FIG. 1A.

FIGS. 1A-1C and 2A-C show two different types of composite pallets 100 and 200, which are subject to this disclosure. With reference to FIGS. 1A-1C, composite pallet 100 includes, generally, a bottom section 102 comprised of an annular ring 108 and a top section 104 with a z-shaped profile that has a flange 105 extending outwardly from an annular ring 110. The bottom section 102 and top section 104 are each formed from a suitable material, such as steel, and are combined together by welding, for example, to provide a unitary structure. The annular ring 108 of bottom section 102 functions to support arid position the pallet 100 on a base (not shown) during the manufacture of a concrete product. The annular ring 108 of bottom section 102 has a plurality of notches 106 spaced apart around the circumference of the bottom edge of annular ring 108 to provide access for the forks on a fork lift that is used to transport the pallet 100 containing the concrete product after it is formed and while the product is curing.

FIGS. 1A-1C and 2A-C show two different types of composite pallets 100 and 200, which are subject to this disclosure. With reference to FIGS. 1A-1C, composite pallet 100 includes, generally, a bottom section 102 comprised of an annular ring 108 and a top section 104 with a z-shaped profile that has a flange 105 extending outwardly from an annular ring 110. Annular ring 110 has a substantially perpendicular portion 116 connected to flange 105 by a radius 118. The bottom section 102 and top section 104 are each formed from a suitable material, such as steel, and are combined together by welding, for example, to provide a unitary structure. The annular ring 108 of bottom section 102 functions to support and position the pallet 100 on a base (not shown) during the manufacture of a concrete product. The annular ring 108 of bottom section 102 has a plurality of notches 106 spaced apart around the circumference of the bottom edge of annular ring 108 to provide access for the forks on a fork lift that is used to transport the pallet 100 containing the concrete product after it is formed and while the product is curing.

Once formed as described above, the pallet 100 is then inserted into a mold or casting that contains a suitable polymer, to coat the top edge of ring 110 and the flange 105. The polymer coating is more described below. After the polymer has cured, the pallet 100 is removed from the casting leaving the top edge and outside surface of steel ring 110 flange 105 coated with polymer layers 112 and 114. More particularly, polymer layer 114 is combined to flange 105, with polymer bevel 115 extending out beyond flange 105, and substantially perpendicular portion 116 with a radius 117 that is greater than radius 118 between flange 105 and the substantially perpendicular portion 116. Polymer layers 112 and 114 create a substantially smooth surface, which is required for the proper manufacture of quality concrete products.

In the foregoing embodiments, a low-friction polymer is used so the concrete products can be easily removed from the pallets. Examples of low-friction polymers include polymers with PTFE, such as Teflon®, or graphite as a release agent. In such embodiments, an additional flange or protrusions (not shown) can be formed in the top section 104 of pallet 100 to prevent the polymer layer from sliding or shifting. The protrusions provide a void that fills with the polymer and acts as a "hook" to secure the polymer layer to the pallet structure. Alternatively, a frictional polymer is used. A releasing agent is coated on the surface after the polymer has cured and before pallet 100 and 200 are used.

Figure 2C:
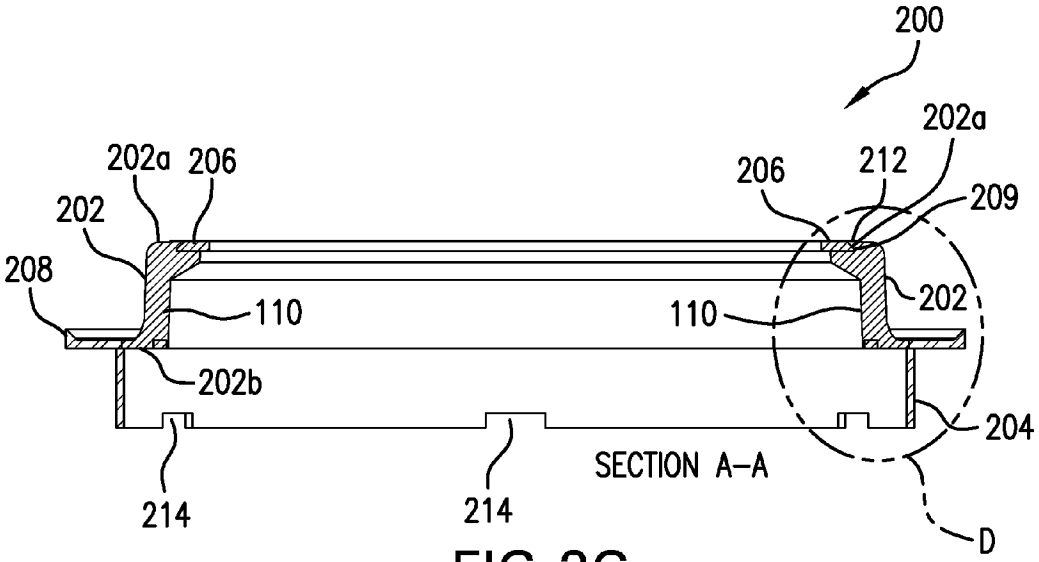
FIG. 2C is a side view of the pallet of FIG. 2A.
Figure 2D:
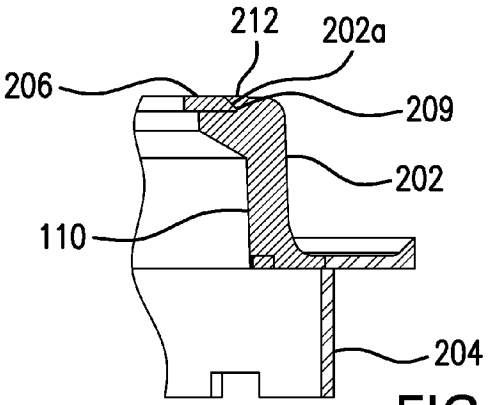
FIG. 2D is a close up view of the area D of FIG. 2C.
Figure 2A:
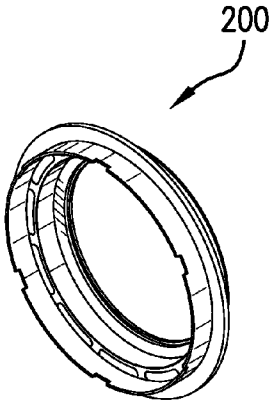
FIG. 2A is a perspective view of a second embodiment of a pallet for concrete pipe.
Figure 2B:
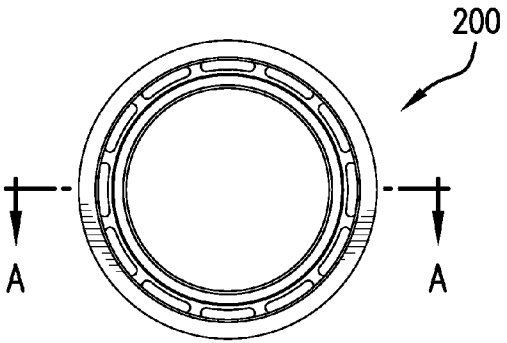
FIG. 2B is a top view of the pallet of FIG. 2A.

FIGS. 2A-2C show another embodiment of a pallet of the invention, concrete pallet assembly 200. Concrete pallet assembly 200 includes an upper concrete support structure 202 made from a high strength concrete with an aggregate and binder curve that, when cured, forms an extremely smooth surface with very low water permeability. Support structure 202 has a generally z-shaped cross-sectional shape. The bottom section of the pallet is comprised of an annular steel ring 204 that supports support structure 202. An upper steel or plastic flat annular flange 206 is fixed into a top latitudinal portion 202*a* of support structure 202 for adding additional strength to a weak point of support structure 202. Flange 206 has a chamfer 212 around its periphery that is bonded to a notch 209 of structural support 202. A bottom steel or plastic annular flange 208 is fixed into a bottom latitudinal portion

202*b* of support structure 202 for adding additional strength to a weak point of support structure 202. Similar to the embodiment of FIGS. 1A-1C, a plurality of spaced apart notches 214 are formed in the bottom edge of the flange 208.

In an alternative embodiment, flanges 206 and 208 are integral with support structure 202, so that the entire pallet 200 is made from high strength concrete. The choice of material for support structure 202 depends on the type of concrete structures, including their size and weight that are being manufactured. Lighter concrete structures can be positioned on a pallet 200 that doesn't include the extra plastic or steel reinforcements in support structure 202.

In manufacturing the pallet assembly 200, flanges 206 and 208 are positioned in the casting mold before the concrete is added, so the concrete support structure 202 and flanges 206 and 208 are secured together once the curing process is complete. Top latitudinal portion 202*a* of support structure 202 can be prone to cracking, without the addition of flange 206. A chamfer 212 on the end of flange 206 allows concrete to bind on both sides of flange 206 to secure the two together. Flange 208 provides additional structural strength to bottom latitudinal portion 202*b* of support structure 202, which also can be a structurally, weak point on pallet assembly 200.

The foregoing embodiments advantageously provide a pallet having a substantially smooth surface and finish within a precise tolerance without the need to machine the surface. This way the concrete pipe can be formed on the pallet and the tight tolerances and smooth finish of the pallet will allow the concrete pipe to cure and form without deformation.

While the present invention has been particularly shown and described with reference to exemplary embodiments thereof, it should be understood by those of ordinary skill in the art that various changes, substitutions and alterations can be made herein without departing from the scope of the invention as defined by appended claims and their equivalents.

What is claimed is:

1. A composite pallet for supporting a load, comprising:

an inner structural support having a bottom section and a top section, wherein the top section has a flange with an upward facing load bearing surface and a substantially perpendicular portion combined to the flange with a radius connecting the flange and the substantially perpendicular portion; and a polymer layer molded to the upward facing load bearing surface of the flange and the substantially perpendicular portion and having a polymer radius between polymer layer on the flange and the polymer layer on substantially perpendicular portion that is greater than the radius between the flange and the substantially perpendicular portion, and wherein the polymer layer forms an outer surface of the composite pallet, wherein the polymer layer is a substantially smooth surface suitable for supporting the load during a curing process.

2. The composite pallet of claim 1, wherein the bottom section is an annular ring.

3. The composite pallet of claim 1, wherein the inner structural support further comprises a top section welded to the bottom section.

4. The composite pallet of claim 1, wherein the inner structural support further comprises a steel flange combined to a steel substantially perpendicular portion, wherein the polymer layer is molded to the steel flange and the steel substantially perpendicular portion, wherein the outer diameter of the polymer layer combined to the steel substantially perpendicular portion is formed to have substantially a same dimension as an inner diameter of the load.

5. The composite pallet of claim 1, wherein the inner structural support comprises concrete.

6. A composite pallet for supporting a load, comprising:

an inner structural support having a top section with a z-shaped profile, including a flange combined at a radius to a substantially perpendicular portion, the top section positioned on top of a bottom section, wherein the top section has an upward facing load bearing surface; and a polymer layer molded to the upward facing load bearing surface of the flange and the substantially perpendicular portion and having a polymer radius between polymer layer on the flange and the polymer layer on the substantially perpendicular portion that is greater than the radius between the flange and the substantially perpendicular portion, and wherein the polymer layer forms an outer surface of the composite pallet, wherein the polymer layer is a substantially smooth surface suitable for supporting the load during a curing process.

7. The composite pallet of claim 6, wherein the bottom section is an annular ring.

8. The composite pallet of claim 7, wherein the inner structural support further comprises a top section welded to the bottom section.

9. The composite pallet of claim 6, wherein the inner structural support comprises concrete.

10. The composite pallet of claim 9, and further comprising a steel flange circumscribing an inner circumference of the top section.

11. The composite pallet of claim 10, wherein the steel flange has a chamfer around a periphery that is bonded to a notch around a circumference of the inner structural support.

12. The composite pallet of claim 6, wherein the polymer layer comprises a low-friction element comprising one chosen from PTFE and graphite.

13. A composite pallet for supporting a load, comprising:

an inner structural support having a bottom section and a top section, wherein the top section has a flange with an upward facing load bearing surface;

a polymer layer molded to the upward facing load bearing surface and projecting from the inner structural support to form an outer surface of the composite pallet, wherein the polymer layer is a substantially smooth surface suitable for supporting the load during a curing process; and a polymer bevel molded with the polymer layer and projecting upward from the flange.

14. The composite pallet of claim 13, and wherein the top section has a z-shaped profile wherein the flange projects outward from a center of the composite pallet and has an upward facing surface to support the load.

15. The composite pallet of claim 13, wherein the flange forms the upward facing, load bearing surface, and the flange projects outward from the bottom section.

16. The composite pallet of claim 13, wherein the inner structural support comprises concrete.

17. A composite pallet for supporting a load, comprising:

an inner structural support having a bottom section and a top section, wherein the top section has a flange with an upward facing load bearing surface;

a polymer layer molded to the upward facing load bearing surface and projecting from the inner structural support to form an outer surface of the composite pallet, wherein the polymer layer is a substantially smooth surface suitable for supporting the load during a curing process; and a polymer bevel molded with the polymer layer and projecting upward from the flange.

18. The composite pallet of claim 17, and further comprising a substantially perpendicular portion combined to the flange and having a radius between the flange and the substantially perpendicular portion, and wherein the polymer layer is combined to the flange and the substantially perpendicular portion and has a radius between the flange and the substantially perpendicular portion that is greater that the radius between the flange and the substantially perpendicular portion.

19. The composite pallet of claim 17, wherein the inner structural support comprises concrete.

* * * * *